US010112082B2

(12) United States Patent
Ahmed

(10) Patent No.: US 10,112,082 B2
(45) Date of Patent: Oct. 30, 2018

(54) BALL WITH INCREASED FLEXURE

(71) Applicant: Mohammed Ejaz Ahmed, Glenmont, NY (US)

(72) Inventor: Mohammed Ejaz Ahmed, Glenmont, NY (US)

( * ) Notice: Subject to any disclaimer, the term of this patent is extended or adjusted under 35 U.S.C. 154(b) by 0 days.

(21) Appl. No.: 15/379,382

(22) Filed: Dec. 14, 2016

(65) Prior Publication Data

US 2018/0161635 A1 Jun. 14, 2018

(51) Int. Cl.
*A63B 41/08* (2006.01)
*A63B 41/02* (2006.01)

(52) U.S. Cl.
CPC ..... *A63B 41/08* (2013.01); *A63B 41/02* (2013.01)

(58) Field of Classification Search
CPC ..... A63B 41/02; A63B 41/08; A63B 41/10; A63B 41/085
See application file for complete search history.

(56) References Cited

U.S. PATENT DOCUMENTS 1,502,784 A * 7/1924 Kennedy ..... A63B 37/00 473/598
1,923,236 A * 8/1933 Sonnett ..... A63B 41/08 473/599
2,317,939 A * 4/1943 Riddell ..... A63B 41/08 156/147
3,119,618 A * 1/1964 Molitor ..... A63B 41/00 273/DIG. 8
3,506,265 A * 4/1970 Hiroshi ..... A63B 41/00 473/125
4,462,590 A * 7/1984 Mitchell ..... A63B 41/08 273/DIG. 8
4,660,831 A * 4/1987 Kralik ..... A63B 41/00 473/603
5,772,545 A * 6/1998 Ou ..... A63B 41/00 156/170
6,206,795 B1 * 3/2001 Ou ..... A63B 41/08 473/599
6,220,979 B1 4/2001 Chan
6,402,647 B1 * 6/2002 Haseltine ..... A63B 41/00 473/423
6,503,162 B1 * 1/2003 Shishido ..... A63B 41/08 473/599
6,726,583 B1 * 4/2004 Lai ..... A63B 41/10 473/599
7,645,203 B2 * 1/2010 Tang ..... A63B 41/085 473/604
7,854,672 B2 * 12/2010 Huang ..... A63B 37/12 473/598
8,382,619 B2 * 2/2013 Bulfin ..... A63B 41/08 156/147
8,602,927 B2 * 12/2013 Marc ..... B29D 22/04 473/605

(Continued)

*Primary Examiner* — Steven Wong
(74) *Attorney, Agent, or Firm* — Lawrence D. Cutter, Esq.

(57) ABSTRACT

An object, such as a soccer ball, is provided with perforated, interior panels disposed between an interior inflatable bladder and an outer covering which is stitched together from a plurality of individual panels. The stitching process produces raised portions surrounding the interior sides of the outer covering. These raised portions define recesses into which the perforated interior panels are disposed. The recess-filling panels overlie the ridges which are hard and whose hardness is counteracted by these preferably perforated panels. This provides a smooth surface against which the inflatable bladder rests. Additional flexure is also provided by perforating one or more of the layers in the outer covering.

10 Claims, 11 Drawing Sheets

(56) References Cited

U.S. PATENT DOCUMENTS

| | | | | |
|---|---|---|---|---|
| 8,708,847 | B2 * | 4/2014 | Berggren | A63B 41/08 473/604 |
| 8,926,459 | B2 * | 1/2015 | Berggren | A63B 41/00 473/604 |
| 8,974,330 | B2 * | 3/2015 | Berggren | A63B 41/08 473/604 |
| 9,011,621 | B1 | 4/2015 | Hussain | |
| 9,101,802 | B2 | 7/2015 | Hussain | |
| 9,186,559 | B1 * | 11/2015 | Hussain | A63B 41/02 |
| 9,586,098 | B1 * | 3/2017 | Ahsan | A63B 41/08 |
| 9,682,286 | B2 * | 6/2017 | Shishido | A63B 41/08 |
| 2002/0086749 | A1 * | 7/2002 | Ou | A63B 41/00 473/604 |
| 2003/0073527 | A1 * | 4/2003 | Ou Chen | A63B 41/00 473/604 |
| 2003/0228946 | A1 * | 12/2003 | Chan | A63B 41/00 473/604 |
| 2004/0018902 | A1 * | 1/2004 | Hu | A63B 41/08 473/604 |
| 2004/0121865 | A1 * | 6/2004 | Lee | A63B 41/08 473/597 |
| 2005/0277499 | A1 * | 12/2005 | Tang | A63B 41/085 473/604 |
| 2006/0046880 | A1 * | 3/2006 | Tang | A63B 41/08 473/604 |
| 2010/0167850 | A1 * | 7/2010 | Lin | A63B 41/00 473/605 |
| 2016/0101326 | A1 * | 4/2016 | Ou | A63B 41/02 473/605 |
| 2017/0072270 | A1 * | 3/2017 | Shishido | A63B 41/08 |

* cited by examiner

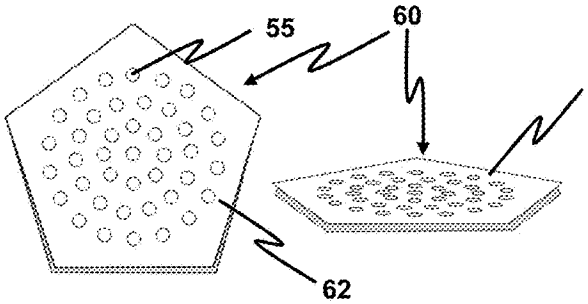
Fig. 8
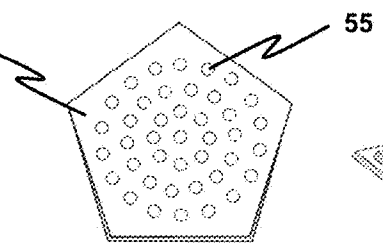
Fig. 9
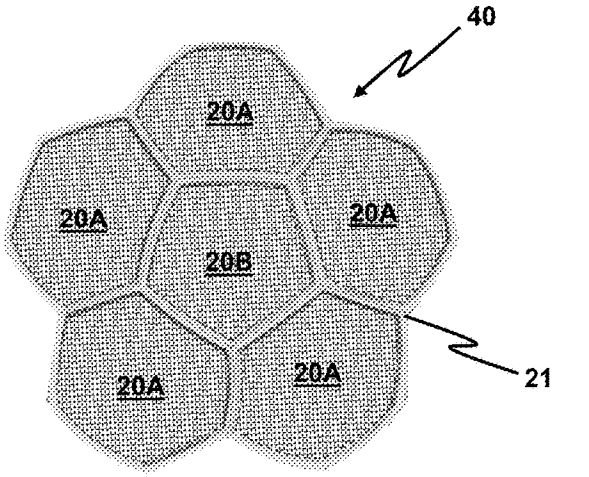
Fig. 10
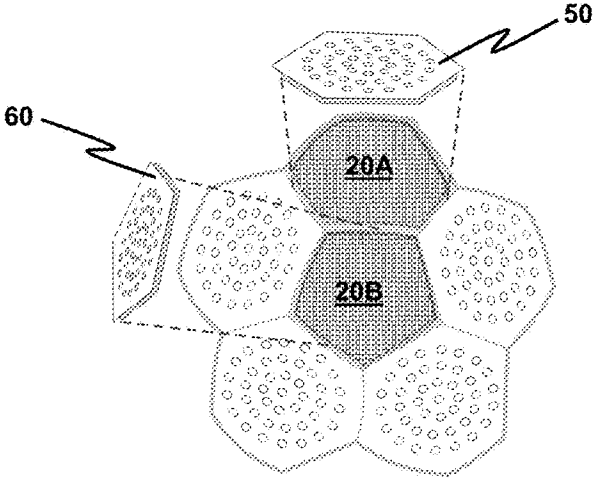
Fig. 11
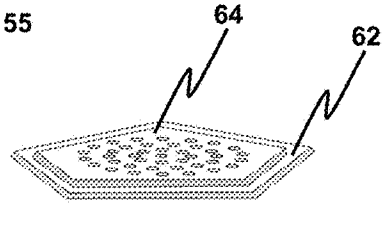

BALL WITH INCREASED FLEXURE

TECHNICAL FIELD

The present invention is generally directed to balls for sports activities. More particularly, the present invention is directed to balls used for playing soccer. Even more particularly, the present invention is directed to soccer balls having greater flexibility, less hardness, and are safer to use.

BACKGROUND OF THE INVENTION

The sport of soccer is a particularly popular one which enjoys worldwide interest. The sport of soccer does, however, incorporate certain rules and regulations which can result in injury. In particular, the use of the head as a means for interacting with a soccer ball which is in play is capable of producing both head and neck injuries. In particular, is known that circumstances have arisen in which playing soccer has resulted in concussive injuries. While the game of soccer does permit the use of other body parts for purposes of impelling the ball, the use of the head as a means for striking the ball has resulted in the pleas and admonitions of many to prevent "heading" the ball by players under the age of 10 years. Accordingly, it is seen that many of those engaged in the playing and administration of this sport have themselves recognized that certain dangers exist.

It is therefore seen that it would be desirable and advantageous to have a soccer ball which is capable of greater flexure during play which would produce a lesser impact during play. However, those engaged in the sport of soccer would not want to deviate significantly from the "feel" provided by current soccer ball designs. In particular, those playing soccer, either as amateurs or as professionals, have a certain expectation as to the weight, heft, feel, texture and even angular momentum associated with currently available commercial soccer balls. The Fédération Internationale de Football Association (FIFA) has in fact established standards for soccer ball manufacture and construction.

It is important to stress the fact that the manufacture of soccer balls and similar sporting objects employ the stitching together of variously shaped panels. This stitching may be done by hand or by machine; in either case the same difficulties arise. By selecting the shape of the individual panels and their placement with respect to one another, virtually any desirably shaped sports object can be manufactured. With specific reference to the manufacturer of soccer balls, it is to be noted that the individual panels that are employed are hexagonal and pentagonal in shape. These shapes are sewn together in the familiar black and white truncated icosahedron pattern. In this manufacturing method, the edges of the panels are folded down at substantially right angles to the panels themselves. These folded down portions are then abutted and stitched together. It is important for properly understanding the advantages of the present invention that one appreciates that this manufacturing process results in the formation of a network of hard structures across the entire surface of the soccer ball along its seams. These hard structures are formed from the stitched together and folded down edges of the panels. As a consequence, soccer players constantly impact hard portions of a soccer ball during ordinary play. This is particularly relevant when the contact with the hard portions of the soccer ball occurs when the ball is struck by the players head.

While the present invention is described in reference to a standard soccer ball, it is noted that the practice thereof is not so limited. The present invention is also usable in the construction and utilization of training footballs, match footballs, professional match footballs, beach footballs, street footballs, indoor footballs, turf balls, futsal footballs, mini/skills footballs and handballs.

Accordingly, there is a need in this sport to provide a safer, commercially acceptable soccer ball whose production costs and methods are not prohibitive and would provide the same level of feel and comfort that is not currently available. From the above, it is therefore seen that there exists a need in the art to overcome the deficiencies and limitations described herein and above.

SUMMARY OF THE INVENTION

In a preferred embodiment of the present invention there is provided an object for sports play, such as a soccer ball, comprising a plurality of exterior, sewn together panels stitched together so as to form a closed volume. The exterior panels have raised, edges surrounding the panels on the interior of the sporting object. These (hard) edges are produced by the stitching process, as described above. Accordingly, each panel has associated with it a recessed area which is essentially coextensive with the panel. There is also provided an inflatable bladder which occupies the closed volume. Most relevant to the present invention there is provided interior panels which fit into these recesses and further include a portion which extends over the stitching edges so as to provide a degree of cushioning not found in currently available soccer balls.

Additionally, it is desirable in one embodiment of the present invention that the panels that fill the recesses also include a plurality of perforations. These perforations provide greater flexibility in the surface of the ball. Perforations may be provided either with or without panel portions that are shaped to cover the raised stitching. Likewise, interior panels of the present invention that are designed to cover the raised stitching may not necessarily include an array of perforations. Perforations may also be provided in an interior layer of the outer surface of the ball. The two layers with perforations work cooperatively with one another to provide greater flexure and softer impact with the ball. The result is a smooth surface against which the interior inflated bladder pushes. It is thus seen that these perforated interior panels provide greater flexure for the object and correspondingly greater safety for the user/player.

In accordance with a first embodiment of the present invention an object for sports play comprises a plurality of exterior, stitched together panels sewn at their edges, configured to form a closed volume and forming, by the stitching, raised interior edges at the edges of the panels. Thus, each panel has associated with it an interiorly facing recessed area which is essentially coextensive with the panel and defined by the raised edges. There is, of course, an inflatable bladder which occupies the interior of the closed volume. In accordance with the present invention there is also provided plurality of interior panels which are disposed between the bladder and the exterior panels. The interior panels occupy the aforementioned recesses and have wider portions which cover the interior raised edges. In this manner, the hard network of internal edging material is provided with an overlying, cushioning structure. Whereby said perforated interior panels provide greater flexure.

In accordance with another embodiment of the present invention, the plurality of interior panels are provided with perforations, typically in a patterned array, which provide greater flexure of the object surface. These perforations provide a more flexible sporting object by themselves whether or not they are employed in conjunction with interior panel portions which at least partially overlie the raised edges. It is these raised edges which are seen to be hard and which can be made to appear softer by widening a portion of a perforated panel.

Accordingly, it is an object of the present invention to provide a sporting object, such as a soccer ball, which is safer to use.

It is an object of the present invention to shield a player from impact against harder, stitched portions of a sporting object such as a soccer ball.

It is a further object of the present invention to provide a cushioning layer that covers the raised stitching found on the inside of the ball.

It is another object of the present invention to provide improvements in the exterior surface/panels of a soccer ball.

It is yet another object of the present invention to provide better cooperation between flexing components seen in the exterior surface of a soccer ball and its internal components.

It is a still further object of the present invention to mask the unevenness provided in standard soccer ball manufacture by the stitching together of the exterior panels.

It is also an object of the present invention to thus make a sporting ball which is rounder or in greater conformity with its desired shape.

It is still another object of the present invention to produce a safer soccer ball which is still consistent with the characteristics found in currently acceptable soccer balls used for both amateur and professional play.

Lastly, but not limited hereto, it is an even further object of the present invention to provide a method for manufacturing soccer balls that does not significantly depart from current methods while at the same time resulting in the production of a safer, more flexible object.

Additional features and advantages are realized through the techniques of the present invention. Other embodiments and aspects of the invention are described in detail herein and are considered a part of the claimed invention. The recitation herein of desirable objects which are met by various embodiments of the present invention is not meant to imply or suggest that any or all of these objects are present as essential features, either individually or collectively, in the most general embodiment of the present invention or in any of its more specific embodiments.

BRIEF DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

FIG. 8 is a view similar to FIG. 5 except that it illustrates the structure of the pentagonal panels employed in the present invention;

FIG. 9 is a view similar to FIG. 6 except that it illustrates the flipside of the pentagonal panels shown in FIG. 8;

FIG. 10 is a view into a partially assembled soccer ball of the present invention showing the arrangement of the hexagonal and pentagonal panels together with stitching which holds them together along their edges;

FIG. 11 illustrates an important aspect of the present invention in that it shows the placement of interior, perforated panels into recesses produced as the result of the stitching process;

DETAILED DESCRIPTION

The invention herein is described specific reference to a soccer ball. However, as indicated above, it is known that soccer balls have variations and structured to fit various purposes. The scope of the present invention includes all such soccer balls and sporting objects for which the stitching together of panels produces raised edges along the seams of the stitched panels, these raised edges being hard and lying within the volume enclosed by the object.

Figure 1:
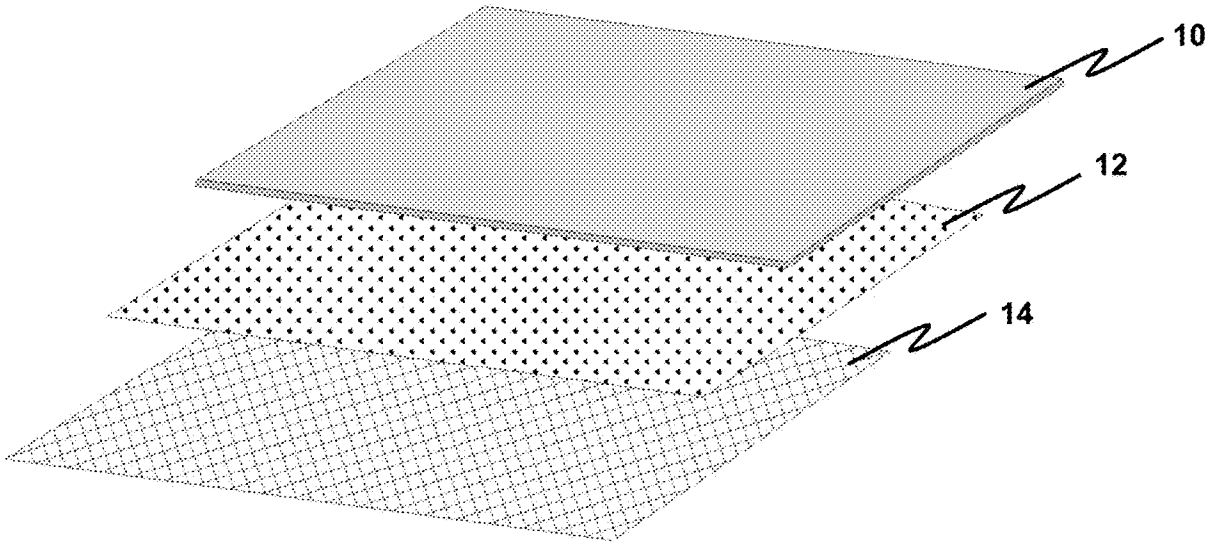
FIG. 1 is an exploded view illustrating three layers typically present in the external surface of a ball such as a soccer ball.

FIG. 1 is an exploded view of a preferred embodiment of the exterior layer of a soccer ball. This is the layer that is visible to the user. This outer layer preferably comprises three individual layers, outer cover material 10, and intermediate layer 12 of perforated EVA (ethyl vinyl acetate) and a third, inner layer 14 comprising fabric material. In preferred embodiments of the present invention intermediate layer 12 is at least partially perforated so as to make it more flexible and also that it works in conjunction with another perforated portion of the completed structure to further increase flexibility. Outer layer 10 is preferably selected so as to be able to receive images printed thereon. Outer layer 10 is also selectable in terms of quality and price of the finished product.

Figure 2:
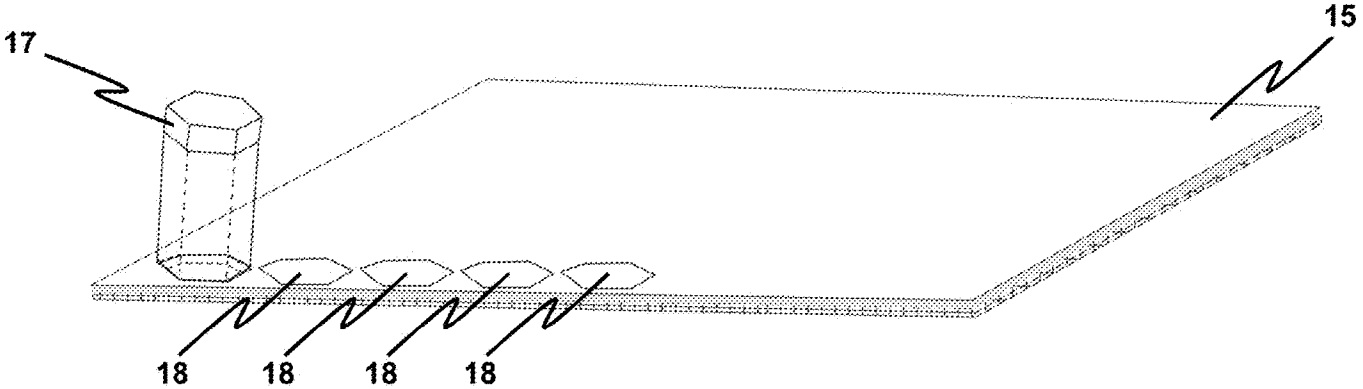
FIG. 2 is an isometric view of a cutter operating to remove hexagonally shaped portions from a material which comprises the external surface of a ball such as a soccer ball.

As indicated, FIG. 1 illustrates the exterior surface of a soccer ball in an exploded form. Moreover, FIG. 2 illustrates the same structure as shown in FIG. 1, but now shown as a single, assembled sheet 15. FIG. 2 also illustrates the use of cutter 17 used to remove hexagonally shaped patterns from sheet 15. Note here that hexagonal patterns are being shown as being removed. For soccer ball construction, removal of pentagonal he shaped patterns are also required, at least for conventional soccer balls. However, as indicated above, any number of differently desired patterns may be punched out for the purpose of stitching them together along various edges to form and enclosed volume. There is no requirement that the patterns be similar or identical only that, when stitched together, a closed surface results.

Figure 4:
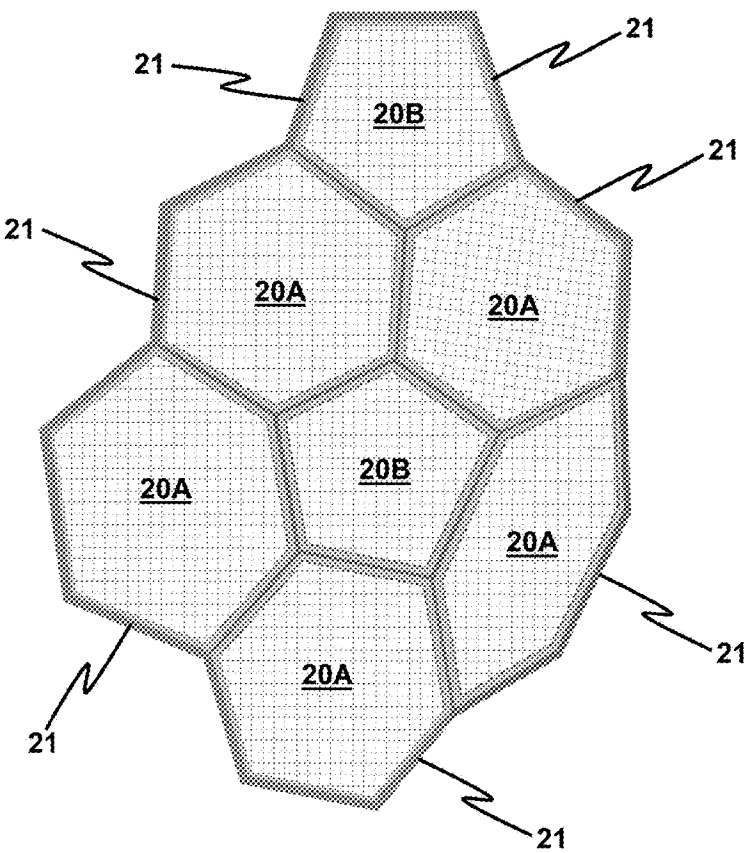
FIG. 4 illustrates the placement of hexagonal and pentagonal panels typically employed in the construction of a soccer ball.
Figure 3:
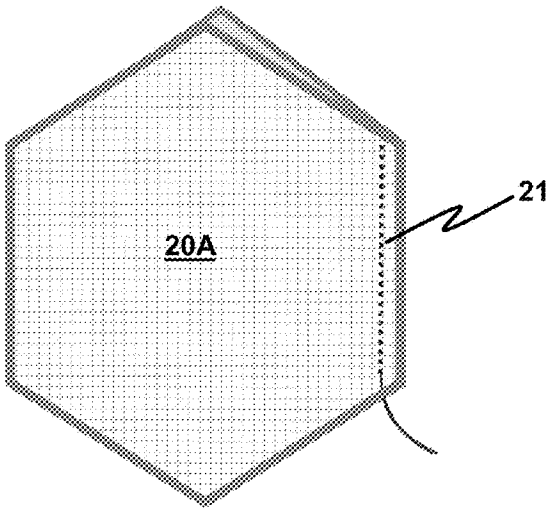
FIG. 3 illustrates a typical hexagonal panel found in a standard soccer ball along with one edge along which stitching is indicated.

FIG. 3 illustrates single panel 20A in the exterior portion of a soccer ball. In particular, raised stitching 21 is shown along one of the edges of the surface. A similar structure exists for pentagonally shaped panels such as panel 20B seen in FIG. 4. More particularly, FIG. 4 illustrates how the exterior surface of a soccer ball is formed. For example, exterior panel 20B is shown stitched to a surrounding array of hexagonal panels 20A. By stitching together a plurality of appropriately shaped exterior panels along corresponding edges, any desirably shaped volume may be created. However, the desired shape illustrated herein is out of the standard soccer ball. It is important to notice the presence in FIG. 4 of stitching 21 present along the edges of the variously employed panels. In each case stitching 21 comprises two turned in layers from adjoining panels sewn together by thread. As indicated above, this is done either by machine or by hand. In either case the resulting structure is a network of ridges that are raised in a direction extending inward toward the center of the object. It is the presence of these ridges which makes soccer balls harder than they have to be. Accordingly, it is seen that, as described above, it is one of the object of the present invention to ameliorate the presence of these hard structures.

Figure 5:
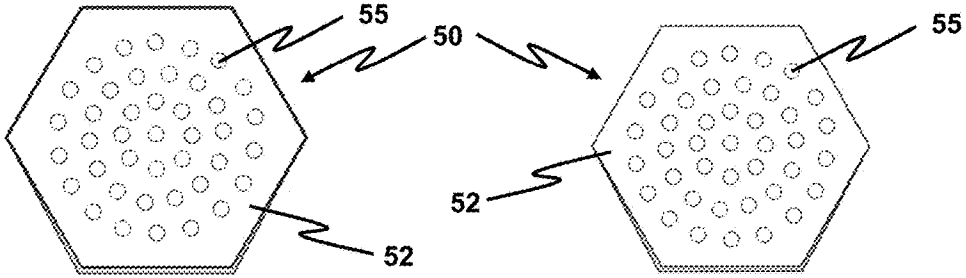
FIG. 5 provides a top and isometric view of a perforated hexagonal panel employed in the present invention.
Figure 6:
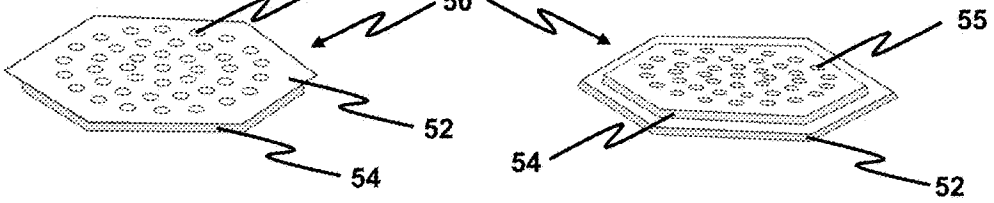
FIG. 6 is a view similar to FIG. 5 except that the hexagonal panel is flipped over so as to render its opposite side viewable.
Figure 7:
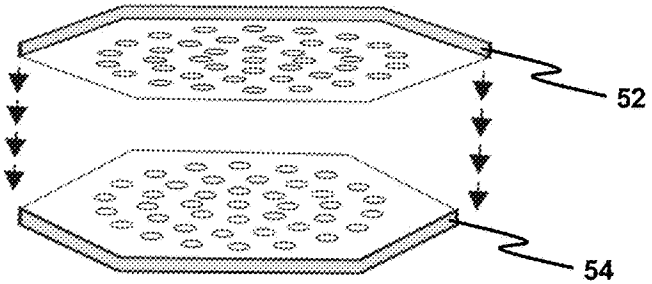
FIG. 7 is an isometric view illustrating the joining of the upper and lower portions of the perforated panels of the present invention.

FIGS. 5, 6 and 7 illustrates the construction of interior panels structured in accordance with the present invention which are intended to lessen the impact of the hardness of ridges 21. In particular, these figures illustrates the fabrication of an inner panel in accordance with the present invention and even more particularly illustrates the fabrication of a hexagonal panel. However, it is noted that pentagonal panels are formed in the same way. Likewise panels of any shape may be fabricated in accordance with the process illustrated in these three figures. The relevant aspect of the interior panel that results from the process shown in these figures is that a portion of the panel is sized and shaped to fill in the recesses formed by the ridges. The other relevant aspect of this interior panel is that portions of it are sized so as to extend over the tops of the ridges. This provides cushioning against the hardness that is characteristic of the stitching between panels.

More particularly, FIGS. 5, 6, and 7 illustrate the fact that these interior panels are preferably perforated so as to provide an increased degree of overall flexibility to the ball. Thus, perforations 55 are shown. These perforations may be provided by any convenient method, such as by punching, and in any convenient pattern. These figures also illustrate the fact that finished internal panel 50 of the present invention preferably comprises two portions: wider portion 52 which is intended to cover ridges 21 and narrower portion 54 which is intended to fit into recesses caused by the ridges. If not formed from an initial monolithic structure, finished internal panel 50 (or 60) is formed by adhesively joining together wider layer 52 with narrower layer 54, as shown in FIG. 7. This is accomplished using any convenient adhesive such as latex. If formed from an initial monolithic structure, finished internal panel 50 is seen to already exist in its desired shape. FIG. 7 illustrates a stage in processing that occurs prior to producing joined-together panel portions 52 and 54.

FIGS. 8 and 9 illustrate the formation of a pentagonal patch 60 in accordance with the present invention. Perforations 55 in both patches 50 and 60 are intended to be aligned in layers 52 and 54 and in layers 62 and 64 in panels 50 and 60, respectively. These pentagonal patches, as well as patches of any shape, are provided with a portion which is intended to fill recesses whose existence is provided by raised ridge portions 21. A second portion of internal patches fabricated in accordance with the present invention is intended to be wider and to overlie those portions of ridges 21 which extend inwardly from the outer surface of the object.

FIG. 10 illustrates a portion 40 of a soccer ball in a partially assembled stage of its manufacture. It also illustrates the interior view of a soccer ball which does not employ the present invention and/or which illustrates the interior view of a soccer ball prior to the inclusion of the present invention. In contrast, FIG. 11 illustrates a stage in manufacture of a soccer ball in which six panels are shown. In particular, four out of six of the panel recesses are already shown as having panels of the present invention disposed therein. It is to be particularly noted that panels 50 and 60 of the present invention are sized and shaped to abut one another, edge to edge, and to cover ridge lines 21. It is important to note the absence of ridgelines in FIG. 11. Panels such as 50 and 60 are preferably held in place within the recesses by means of any convenient adhesive such as latex.

Figure 12:
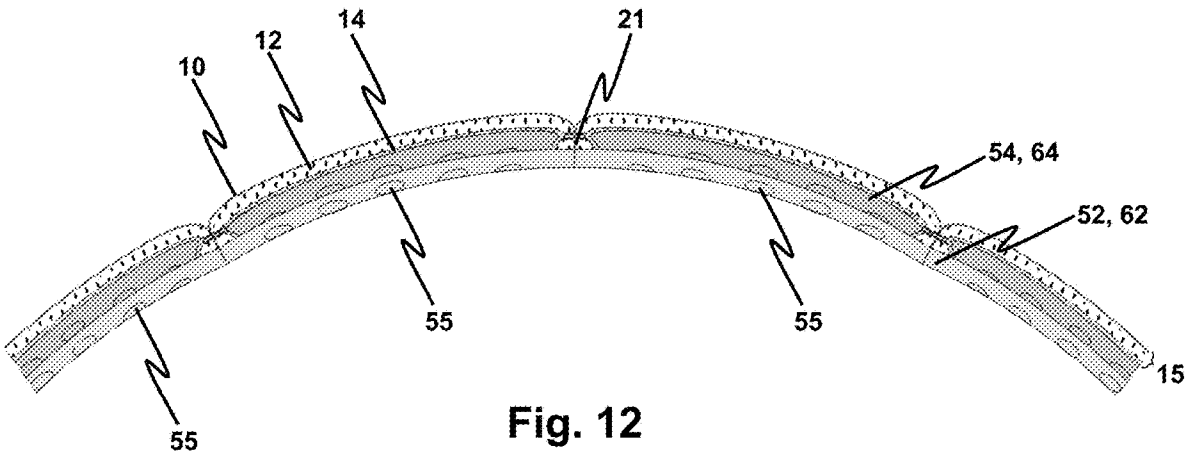
FIG. 12 is a cross-sectional, side elevation view illustrating the structure of a soccer ball in accordance with the present invention and particularly illustrating multiple perforated layers.
Figure 13:
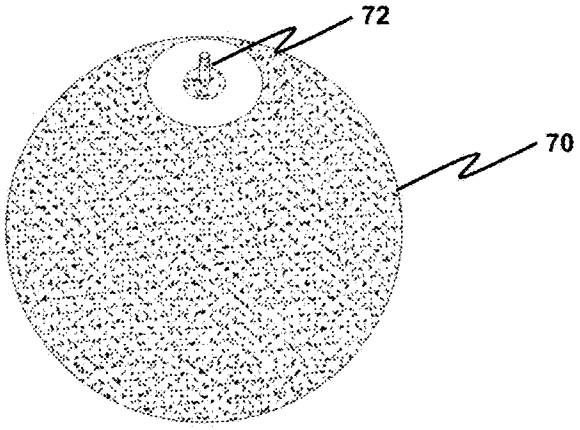
FIG. 13 illustrates an inflatable bladder used in the present invention to hold air or other gases.

FIG. 12 illustrates the cross-section of a soccer ball manufactured in accordance with the present invention. The entire cross-sectional structure is shown except for the presence of inflatable bladder 70 and its corresponding inflation nipple 72, as shown in FIG. 13. In particular, there is shown outer layer 10 which is the visible surface of the ball which may include various forms of imprinting. Next is foam layer 12 which preferably comprises a material such as EVA. In accordance with one embodiment of the present invention foam layer 12 is also at least partially perforated. Below foam layer 12, there is provided fabric layer 14. These three layers are typically provided in the manufacturing process as one layer indicated by reference numeral 15. The outer structure of the soccer ball also includes ridges 21 formed from edges of layer 15 which are bent downwards (that is, inwardly) and stitched together Most importantly for the present invention FIG. 12 also illustrates the presence of panel portions 52 (hexagons, for example) and 62 (pentagons, for example) which operate to fill recesses caused by ridges 21. Equally important are panel portions 54 (hexagons, for example) and 64 (pentagons, for example) which are intended to and are shown as providing a foam layer over ridges 21. This layer of internal paneling is intended to be provided with perforations 55 exemplary ones of which are shown.

Figure 14:
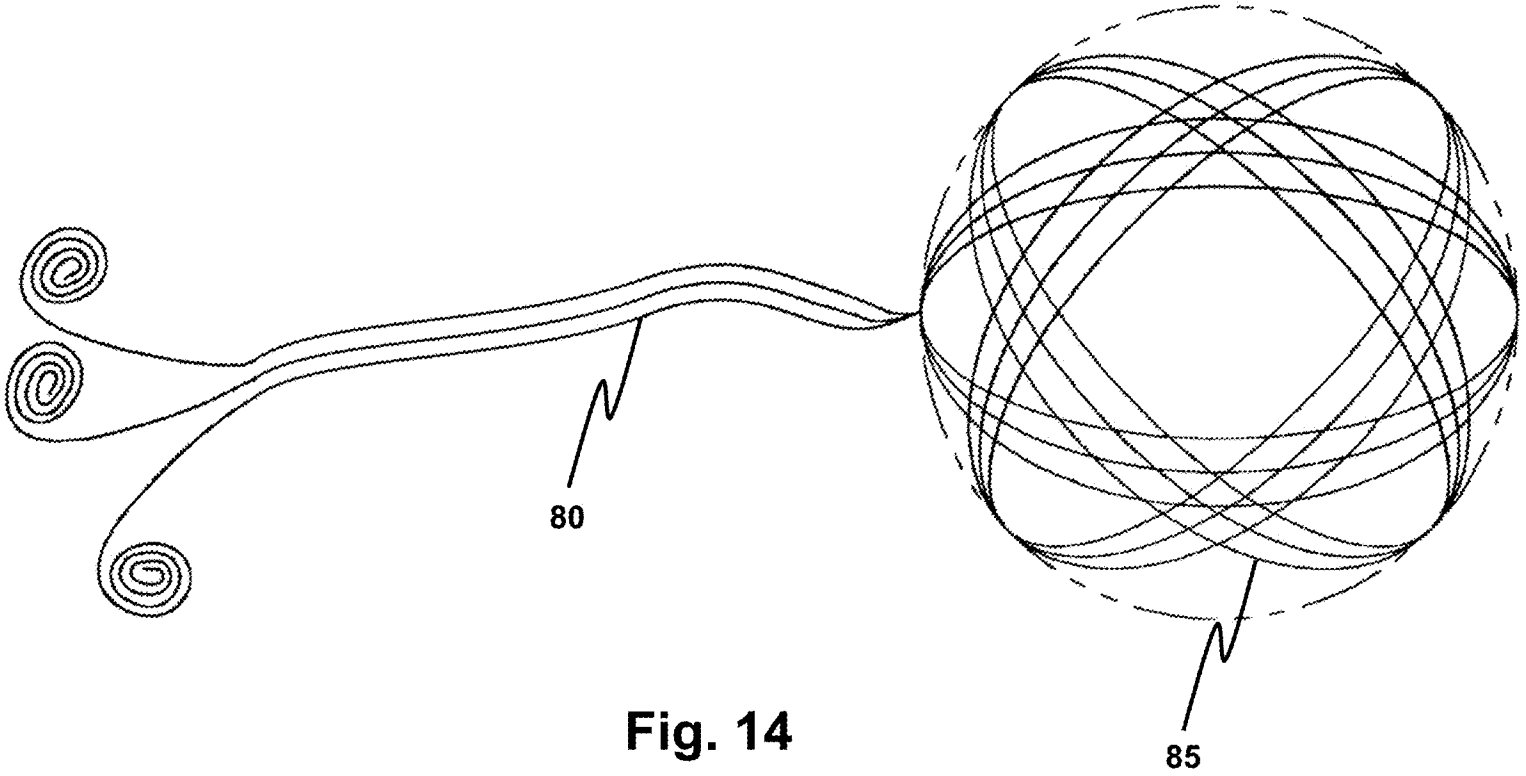
FIG. 14 illustrates the placement of reinforcing thread typically present on the inside of a soccer ball.
Figure 15:
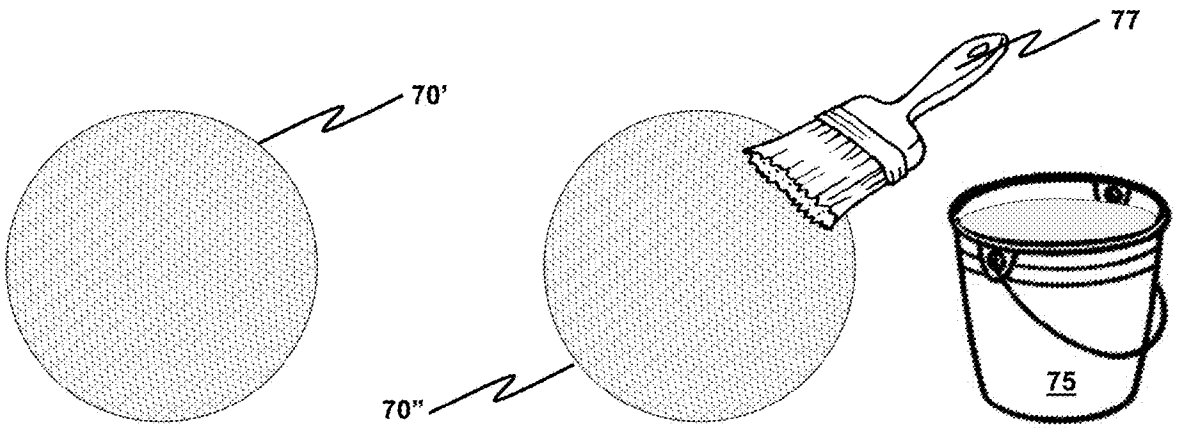
FIG. 15 illustrates the placement of adhesive material on the inflatable bladder for vulcanizing the threads prior to its insertion into an almost complete soccer ball structure.
Figure 16:
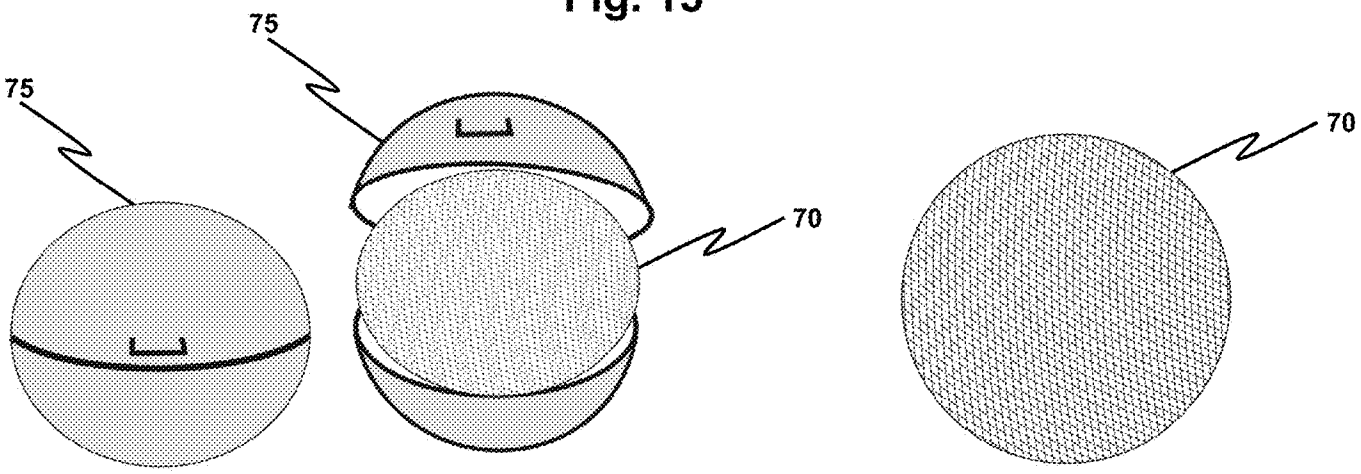
FIG. 16 illustrates the placement of the bladder in a vulcanizing mold.

FIGS. 14 through 16 illustrate the manufacture of a bladder which is suitable for use with the present invention. In particular, FIG. 14 illustrates the placement of reinforcing thread 80 in a spherical pattern 85 around bladder 70. FIG.

15 illustrates a completely wound bladder 70" just prior to the thread covered bladder being coated with latex from bucket 75 brush 77 to form coated bladder 70'. This bladder is then placed in vulcanizing mold 75 from which is produced bladder 70 which is ready for insertion into a soccer ball. While latex is a preferred adhesive for this step in the process, any convenient vulcanizable polymeric adhesive may be employed.

Figure 17:
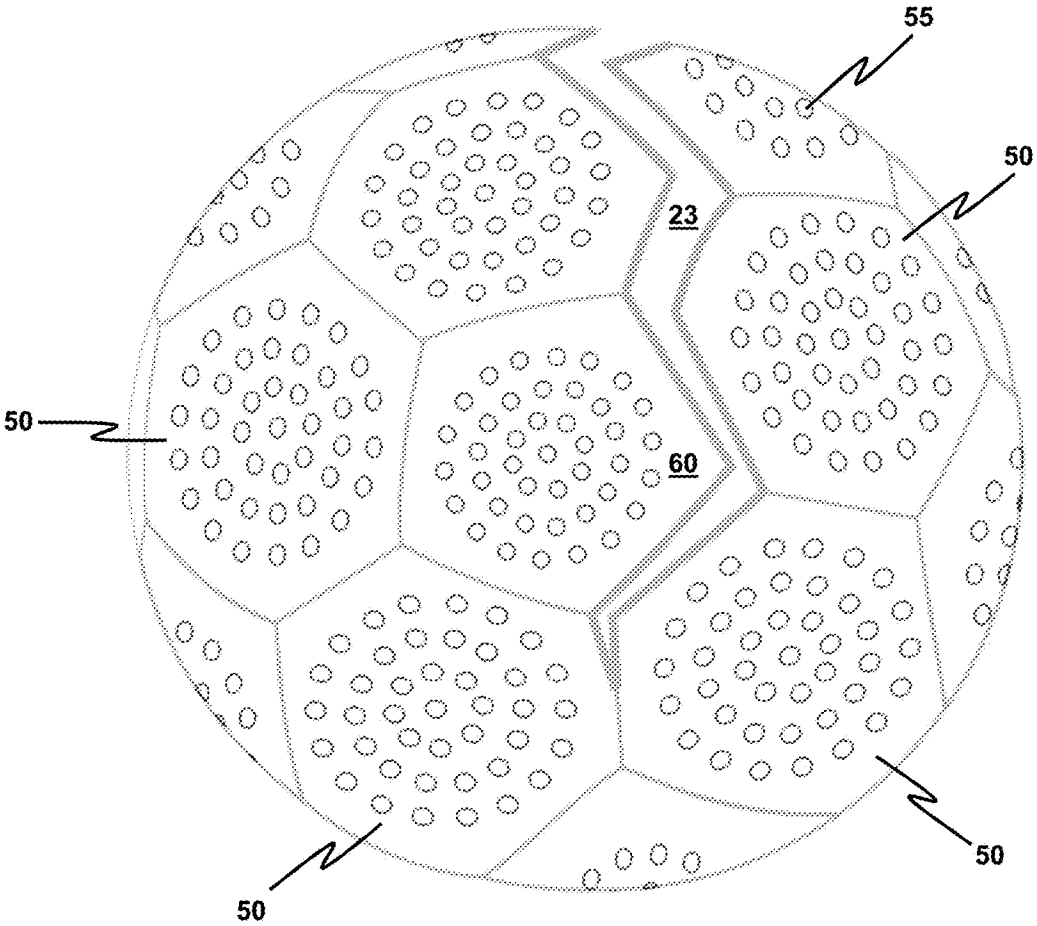
FIG. 17 is a view of the interior of a soccer ball which illustrates a final stage of soccer ball manufacture prior to turning the workpiece inside out and before sewing the final seam.
Figure 19:
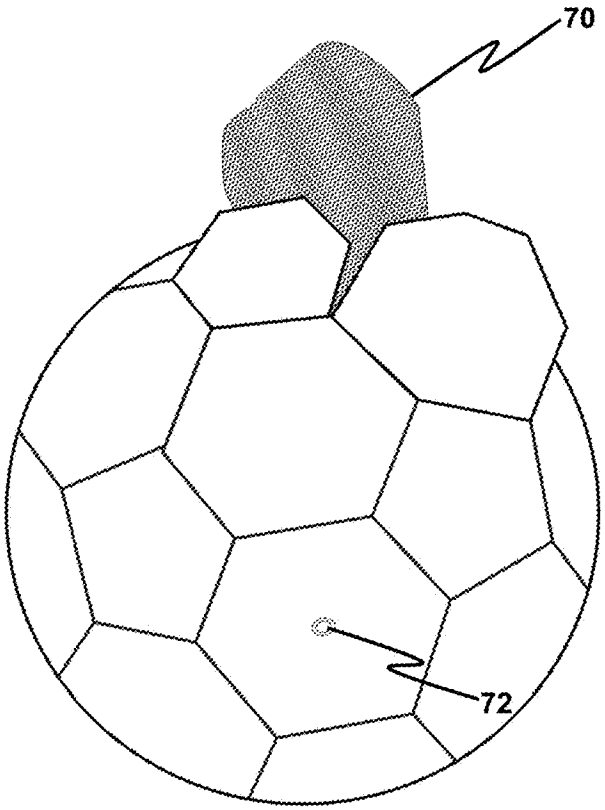
FIG. 19 illustrates a near final stage in soccer ball manufacture and more particularly illustrates insertion of the bladder prior to closure of the final seam.
Figure 18:
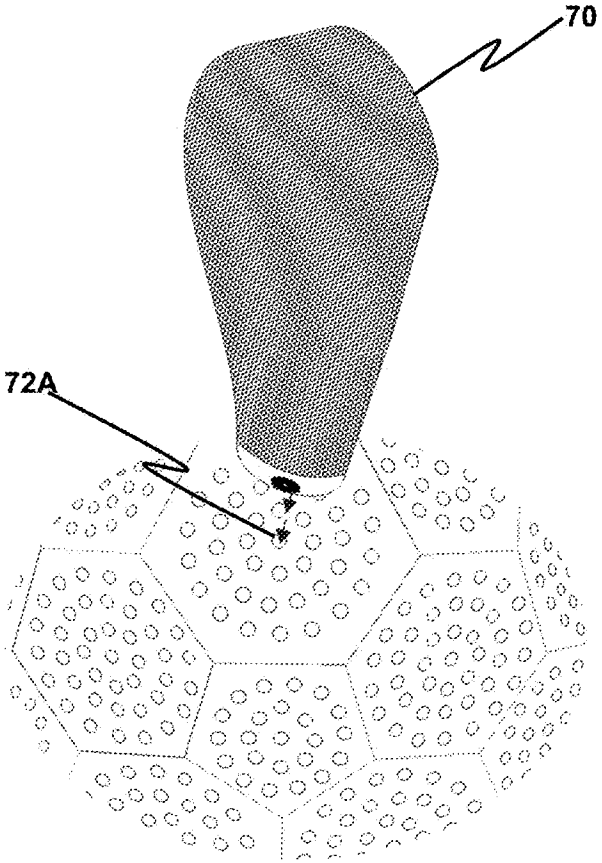
FIG. 18 illustrates disposing the nipple of the bladder through an opening in one of the exterior panels in order to provide a means for inflation.
Figure 20:
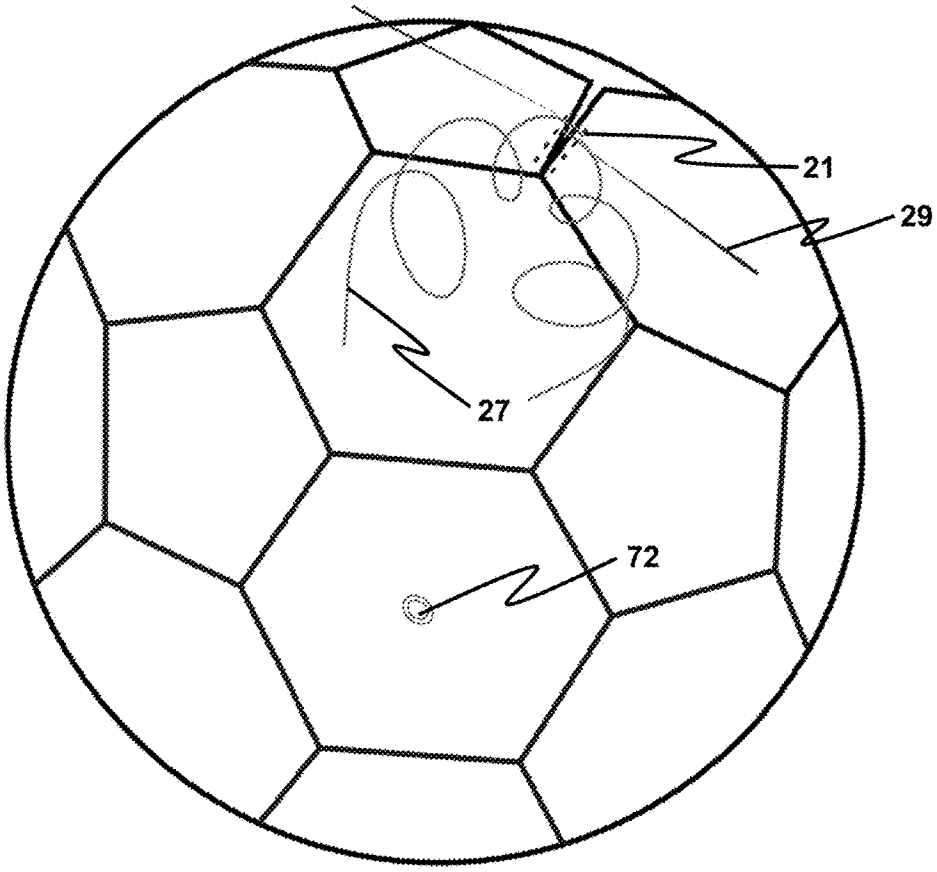
FIG. 20 illustrates closure of the final seam in soccer ball manufacture.
Figure 21:
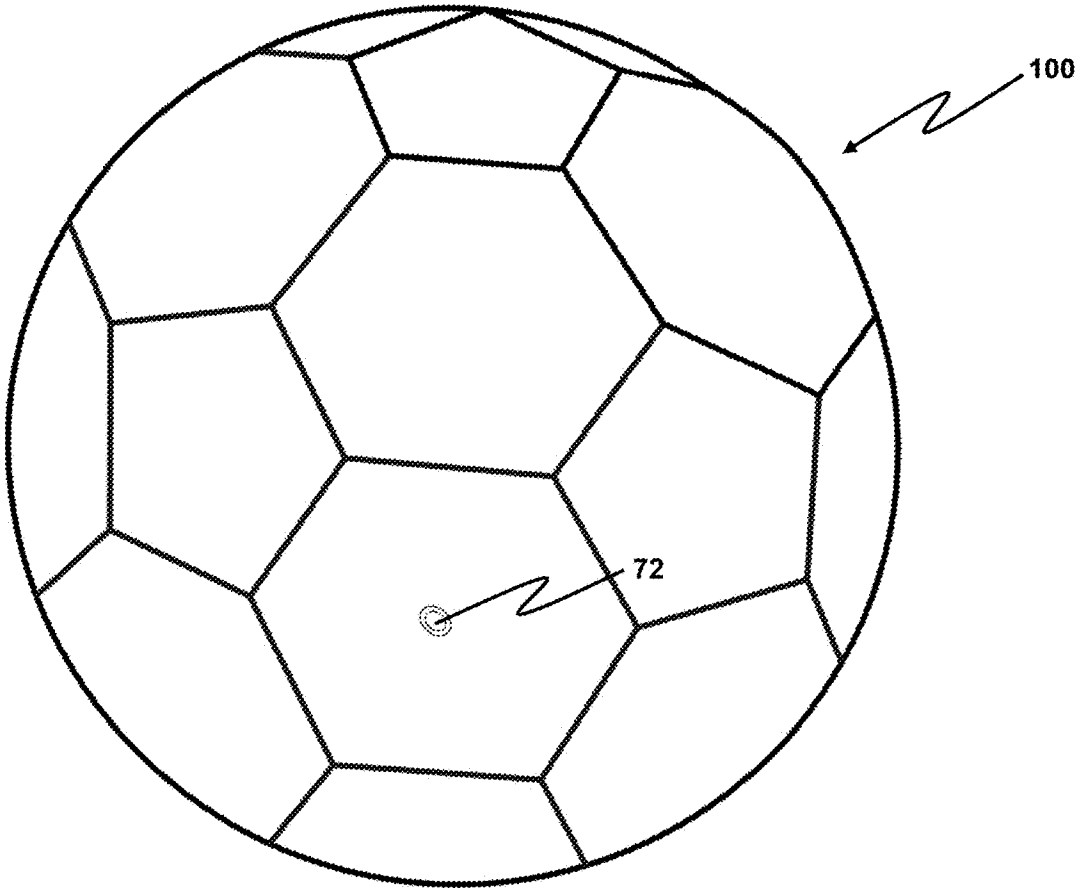
FIG. 21 illustrates a finished soccer ball product.

FIG. 17 illustrates a stage in soccer ball manufacture in which there is present seam 23 which needs to be sewn. This view is a view into the interior of the ball and particularly illustrates the presence of panels 50 and 60 in accordance with the present invention. Note in particular that ridges 21 are no longer visible because they are covered with wider portions of panels 50 and 60. FIG. 18 illustrates the insertion of inflation nipple 72 through opening 72A in one of the panels. Any convenient panel may be selected for this purpose although regulations might specify one in particular. FIG. 19 illustrates a near final stage in the soccer ball manufacturing process and in particular illustrates the final insertion and placement of bladder 70 within the volume defined by the stitched together panels. Bladder 70 is held in place within the outer structure by means of any convenient adhesive, such as latex. FIG. 20 illustrates the final sewing together of the last two panels. FIG. 21 illustrates finished product 100. Clearly, the inventive aspects of the present invention are not visible in this view. However, it is noted that final product 100 comprises essentially three elements: the outer layer, the panels of the present invention which overlay the hard edges found in the ridges, and an inner bladder.

Outer layer 15 preferably includes perforated foam layer 12 but this is not an essential aspect of all embodiments of the present invention. If perforations are provided in outer layer 12, there is no need for these perforations to align with perforations 55 in panels 50 and 60; these outer layer perforations are, however, generally preferred to be smaller than those found in panels 50 and 60. Likewise, intermediate layers comprising panels configured in accordance with the present invention preferably include perforations but, as above these perforations do not constitute an essential aspect of all embodiments of present invention. Furthermore, the perforations relative to panels 52 and 54 and likewise panels 62 and 64 are not required to be aligned.

While foam layer 12 is described as comprising a material such as EVA, other materials may be advantageously employed in accordance with the usual conventions of soccer ball manufacture. Likewise, while latex is described as being used as an adhesive, other adhesives may be employed throughout the assembly process of the present invention, including insertion of the panels into the recesses. Similarly, the interior bladder may be made by other processes in other materials without departing from the scope of the present invention.

While the present invention has been described with particular reference to soccer balls and to the playing of soccer, it should be noted that the structure and methods described herein are equally applicable to sporting objects used in other games. In its broadest sense, the present invention is not limited to the playing of soccer. The present invention is employable in the production of sports objects in those cases in which the sewing together of adjoining panels to form a spherical or other shaped object produces interior depressions into which correspondingly shaped panels of the present invention may be deployed. Likewise, specific materials employed, particularly in the outer layers of the sporting object, are selectable in keeping with the specifically intended sport. Stitchability is the only property that is highly desirable.

All publications and patent applications mentioned in this specification are indicative of the level of skill of those skilled in the art to which this invention pertains. All publications and patent applications are herein incorporated by reference to the same extent as if each individual publication or patent application was specifically and individually indicated to be incorporated by reference.

Although the description above contains many specifics, these should not be construed as limiting the scope of the invention, but as merely providing illustrations of some of the presently preferred embodiments of this invention. Thus, the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 USC § 112, sixth paragraph, unless the element is expressly recited using the phrase "means for."

While the invention has been described in detail herein in accordance with certain preferred embodiments thereof, many modifications and changes therein may be effected by those skilled in the art. Accordingly, it is intended by the appended claims to cover all such modifications and changes as fall within the spirit and scope of the invention.

What is claimed is:

1. An object for sports play comprising:

a plurality of exterior panels, stitched together at their edges, configured to form a closed volume and forming, by said stitching, raised interior ridges at the edges of said exterior panels so that each exterior panel has associated therewith a recessed area essentially coextensive with said exterior panel and defined by said raised interior ridges;

an inflatable bladder occupying said closed volume;

a plurality of flat adjacently disposed interior cushioning panels, said interior panels individually having a layered structure including a first layer which occupies said recessed area and a second layer having a portion which is wider than said first layer, the wider portion of said second layer being disposed between said bladder and said raised interior ridges and separate from said raised interior ridges, said adjacently disposed interior cushioning panels having the same shape as said corresponding recessed area, said second layers of said interior panels abutting one another at their edges directly beneath said stitching.

2. The object for sports play of claim 1 in which said exterior panels include an intermediate layer of perforated material.

3. The object for sports play of claim 1 in which said plurality of interior panels includes perforations.

4. An object for sports play comprising:

a plurality of exterior panels, stitched together at their edges, configured to form a closed volume and forming, by said stitching, raised interior ridges at the edges of said exterior panels so that each exterior panel has associated therewith a recessed area essentially coextensive with said exterior panel and defined by said raised interior ridges;

an inflatable bladder occupying said closed volume;

a plurality of flat adjacently disposed perforated interior cushioning panels, said interior panels individually having a layered structure including a first layer which occupies said recessed area and a second layer having a portion which is wider than said first layer, the wider portion of said second layer being disposed between said bladder and said raised interior ridges and separate from said raised interior ridges, said adjacently disposed perforated interior cushioning panels having the same shape as said corresponding recessed area, said second layers of said interior panels abutting one another at their edges directly beneath said stitching.

5. The object for sports play of claim 4 in which said exterior panels include an intermediate layer of perforated material.

6. The object for sports play of claim 1 further including a reinforcing layer disposed directly over said bladder.

7. The object for sports play of claim 4 further including a reinforcing layer disposed directly over said bladder.

8. The object for sports play of claim 1 in which said first and second layers of said internal panels comprise a monolithic structure.

9. The object for sports play of claim 4 in which said first and second layers of said internal panels comprise a monolithic structure.

10. The object for sports play of claim 1 in which said interior panels include perforations.

* * * * *